US006004219A

United States Patent [19]

Peabody

[11] Patent Number: 6,004,219

[45] Date of Patent: Dec. 21, 1999

[54] GOLF GAME FOR SWIMMING POOLS

[76] Inventor: Dean F. Peabody, 12 Manor Ct., Taylorville, Ill. 62568

[21] Appl. No.: 09/204,964

[22] Filed: Dec. 3, 1998

Related U.S. Application Data

[60] Provisional application No. 60/067,545, Dec. 4, 1997.

[51] Int. Cl.[6] ..... A03B 69/36

[52] U.S. Cl. ..... 473/157; 473/193; 473/165; 473/172

[58] Field of Search ..... 473/157, 162, 473/167, 168, 170, 172, 173, 180, 193, 195–197, 165

[56] References Cited

U.S. PATENT DOCUMENTS 3,601,406 8/1971 Giusti ..... 473/165

3,814,439 6/1974 Simon ..... 473/196

5,655,972 8/1997 Heitzman ..... 473/172

*Primary Examiner*—Mark S. Graham

*Attorney, Agent, or Firm*—Philip L. Bateman

[57] ABSTRACT

A golf game is played with a standard golf club in and around a swimming pool having a surrounding deck. The game contains a floating green made of a sheet of floating foam having a cross-sectional area of at least about 10 square feet with an upper surface covered with a loop-type fabric upper surface. The game also contains a plurality of floating golf balls covered with a hook-type fabric. The game is played by hitting the floating golf balls with the golf club from the deck to the floating green in the pool.

7 Claims, 1 Drawing Sheet

GOLF GAME FOR SWIMMING POOLS

CROSS-REFERENCE TO RELATED APPLICATION

This application claims the benefit of U.S. Provisional Application Ser. No. 60/067,545, filed Dec. 4, 1997, now pending.

FIELD OF THE INVENTION

This invention relates to games. More particularly, this invention relates to swimming pool games.

BACKGROUND OF THE INVENTION

Privately-owned swimming pools in the U.S.A. are used primarily for recreation and amusement. A wide variety of games are played in swimming pools. Some of the more common games are dry land games that are modified for play in the water, such as basketball, polo, and volleyball. In the U.S.A., there are over eight million privately-owned swimming pools and the sale of games for use in swimming pools exceeds several million dollars each year.

Golf is one of the most popular games in the U.S.A. One reason for its popularity is that people of all ages, physical abilities, and skill levels can play the game together. A large number of games derived from golf are played, including miniature golf (also known as putt-putt golf) and video golf games. In addition, many devices for practicing golf have been disclosed. For example, golf stores and mail order catalogs often feature practice golf balls made of hollow plastic or foam, simulated grass practice mats, practice nets into which golf balls are hit, practice putting greens, and the like.

Hook and loop fastening fabrics, such as those sold under the VELCRO trademark, are used for countless purposes. A commercially available game features a playing surface consisting of a sheet of polystyrene covered with loop-type fabric. The playing surface is mounted horizontally on a wall or door. The game is played by throwing bean bags covered with hook-type fabric against the playing surface. Four different designs are available for the playing surface: bullseye, tic-tac-toe, baseball, and shuffleboard.

Despite the popularity of swimming pool games and of golf, there is no game that combines the two. Accordingly, a demand exists for a game that is based on golf but that can be played in and around a swimming pool.

SUMMARY OF THE INVENTION

The general object of this invention is to provide a new game for play in and around a swimming pool. A more particular object is to provide such a game that is based on the game of golf.

I have invented a golf game which is played with a standard golf club in and around a swimming pool having a surrounding deck. The game comprises: (a) a floating green comprising a sheet of floating foam having a cross-sectional area of at least about 10 square feet with an upper surface covered with a loop-type fabric upper surface; and (b) a plurality of floating golf balls covered with a hook-type fabric. The game is played by hitting the floating golf balls with the golf club from the deck to the floating green in the pool.

The game of this invention is fun for people of all ages and physical abilities to play because it combines swimming pools and golf, two very popular recreational activities.

DETAILED DESCRIPTION OF THE INVENTION

Figure 1:
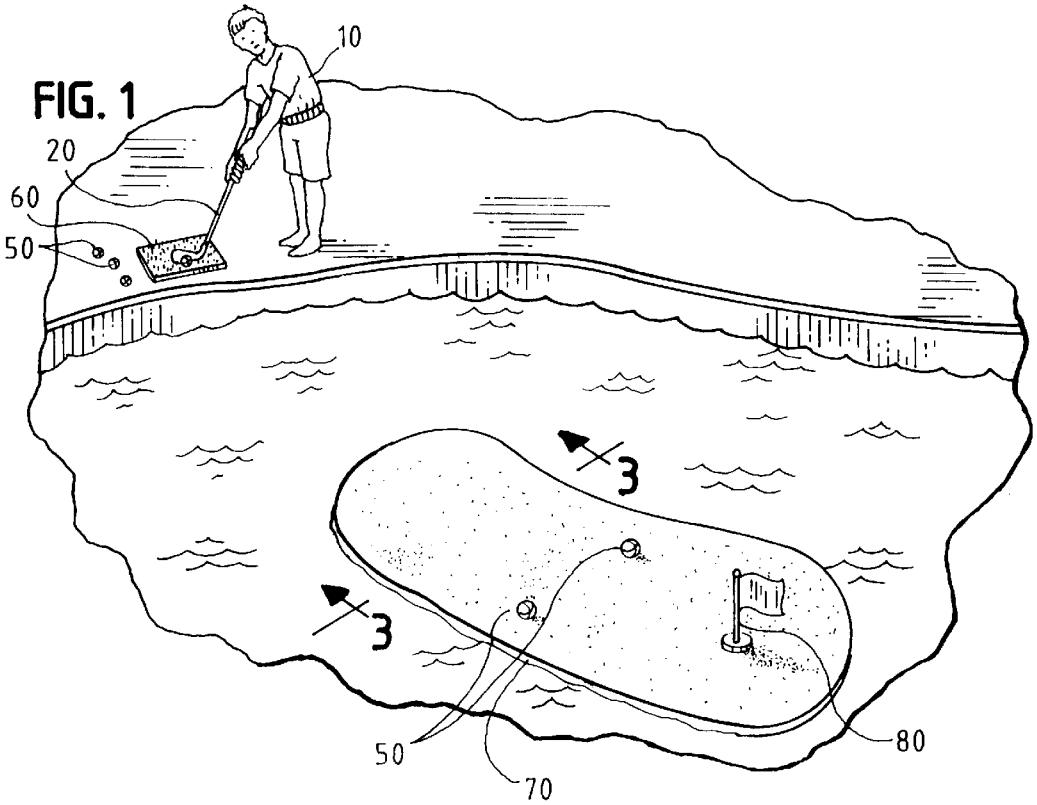
FIG. 1 is a perspective view of a person playing the preferred embodiment of the game of this invention.

This invention is best understood by reference to the drawings. The preferred embodiment of the game is played by a person 10 holding a golf club 20. The person is standing on a deck 30 beside a swimming pool filled with water 40. Plastic golf balls 50 are chipped (hit) from a mat 60 toward a floating green 70. A flag 80 is positioned on the green. Each of these components is discussed in turn.

The golf club is conventional and is preferably a short iron (9 iron, pitching wedge, or sand wedge) because the trajectory imparted by these highly-lofted clubs increases the chances of landing the ball on the green.

Figure 2:
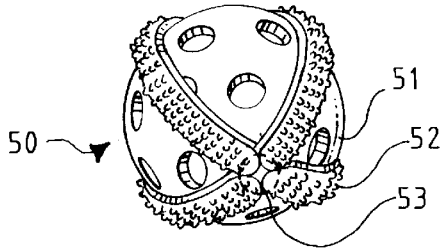
FIG. 2 is a detailed perspective view of one of the plastic golf balls shown in FIG. 1.

The golf balls are conventional practice golf balls partially covered with a hook-type fabric of the type sold under the VELCRO trademark. The golf balls are of the type commonly used for practice in restricted spaces. There are three main types of such balls. The first type of ball is a solid sphere of foam. The second type of ball is a hollow plastic ball. The third type of ball is a hollow plastic ball containing a plurality of holes or slots to improve aerodynamics of the type sold under the WIFFLE trademark. All three types of balls float. The most preferred golf ball is shown in detail in FIG. 2. A conventional WIFFLE brand plastic practice golf ball 51 is covered with two VELCRO hook-type fabric strips 52 which are secured to the surface of the golf ball with adhesive. The strips have a length slightly greater than the circumference of the ball and the ends of each strip are pushed into hole 53. A plurality of golf balls are used in the game and it is preferred that the fabric strips are of different colors so that the balls can be easily distinguished.

The mat is a small section of synthetic grass from which the balls are chipped. The mat is preferably rectangular in shape with dimensions of about 18×24 inches. The mat is preferably made of ASTROTURF fabric or the like that is bound at the edges and that contains a non-skid backing.

Figure 3:
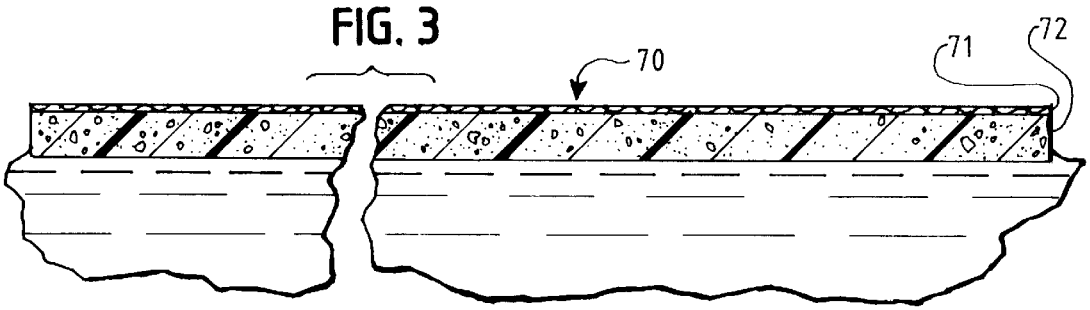
FIG. 3 is a sectional view of the floating green taken along section 3—3 in FIG. 1.

The floating green is the target of the game. As best seen in FIG. 3, the green is preferably a laminate of felt 71 on foam 72. The felt upper surface of the green has a loop-type structure to which the golf balls adhere. The felt is preferably a needle-punch weather-proof polypropylene. The foam provides the floatation and is preferably a closed-cell foam of the type used in life preservers. The felt is preferably flame-laminated to the foam. The green generally has a surface area of at least about 10 square feet so that a person playing the game has a reasonable chance of hitting a ball onto the green. The exact shape and size of the green are matters of choice. The green is preferably about 3×5 feet (giving a surface area of about 15 square feet) to provide a target that is large enough to be reached frequently by a skilled player. The green is preferably irregular in shape (for example, kidney-shaped) and green in color to simulate golf course greens.

The flag is a rectangular piece of material, preferably nylon fabric, attached to a short section of plastic rod attached to a base having a piece of hook-type fabric on its underside. This construction enables the flag to be placed at any desired location on the green.

The game of this invention can be played with in many different ways. Most games are played by players taking turns chipping the balls with the goal being to land the most balls on the green or to land a single ball closest to the flag. As previously mentioned, the use of different-colored balls enables the players to easily identify their balls.

The game is fun for people of all ages, physical abilities, and skill levels to play. For serious golfers, playing the game has the added benefit of improving the ability to chip. The various components of the game are relatively inexpensive, easily stored, and extremely durable and long-lasting. While the game is especially adapted for play in and around swimming pools, the game can also be played enjoyably on solid ground.

I claim:

1. A golf game which is played with a standard golf club in and around a swimming pool having a surrounding deck, the game comprising:

(a) a floating green comprising a sheet of floating foam having a cross-sectional area of at least about 10 square feet with an upper surface covered with a loop-type fabric upper surface;

(b) a flag adapted to be attached to the upper surface of the floating green at any desired location, the flag consisting of a rectangular piece of material attached to a short section of rod attached to a base having a piece of hook-type fabric on its underside; and (c) a plurality of floating golf balls covered with a hook-type fabric; such that a golf game is played by hitting the floating golf balls with the golf club from the deck to the floating green in the pool.

2. The golf game of claim 1 wherein the floating golf balls are made of hollow plastic with holes to improve aerodynamics.

3. The golf game of claim 2 wherein the golf balls are covered with two strips of hook-type fabric.

4. The golf game of claim 3 wherein the floating foam of the green is a closed-cell foam.

5. The golf game of claim 4 wherein the fabric of the green is flame-laminated to the foam.

6. The golf game of claim 5 additionally comprising a mat of synthetic grass from which the golf balls are hit.

7. The golf game of claim 6 wherein the fabric of the green is a needle-punch weather-proof polypropylene.

* * * * *